US006918844B2

(12) United States Patent
Socci

(10) Patent No.: US 6,918,844 B2
(45) Date of Patent: Jul. 19, 2005

(54) TRIGGERING DEVICE FOR BATTERS

(76) Inventor: Roger D. Socci, 11720 Newbridge Ct., Reston, VA (US) 20191

( * ) Notice: Subject to any disclaimer, the term of this patent is extended or adjusted under 35 U.S.C. 154(b) by 0 days.

(21) Appl. No.: 10/650,762

(22) Filed: Aug. 29, 2003

(65) Prior Publication Data

US 2004/0043842 A1 Mar. 4, 2004

Related U.S. Application Data

(60) Provisional application No. 60/406,983, filed on Aug. 30, 2002.

(51) Int. Cl.[7] ..... A63B 69/00

(52) U.S. Cl. ..... 473/458; 473/212; 473/452; 473/422

(58) Field of Search ..... 473/422, 450, 473/458, 464, 452, 615, 59, 207, 212–218; 434/247, 258

(56) References Cited

U.S. PATENT DOCUMENTS

| | | | | | |
|---|---|---|---|---|---|
| 475,432 | A | * | 5/1892 | Blades | 473/415 |
| 2,773,691 | A | * | 12/1956 | Redfield | 473/212 |
| 3,350,096 | A | * | 10/1967 | Kile et al. | 473/452 |
| 3,368,817 | A | * | 2/1968 | Duncan | 473/215 |
| 3,680,869 | A | * | 8/1972 | Brady | 473/213 |
| 4,061,340 | A | * | 12/1977 | Husted | 473/212 |
| 4,743,028 | A | * | 5/1988 | Harrison | 473/212 |
| 5,082,262 | A | * | 1/1992 | Sanchez | 473/458 |
| 5,092,601 | A | * | 3/1992 | Rilling | 473/215 |
| 5,154,416 | A | * | 10/1992 | Smull et al. | 473/458 |
| 5,188,365 | A | * | 2/1993 | Picard | 473/213 |
| 5,354,050 | A | * | 10/1994 | McCarthy | 473/458 |
| 5,375,836 | A | * | 12/1994 | Kiser | 473/458 |
| 5,582,551 | A | * | 12/1996 | Bursi | 473/212 |
| 5,704,856 | A | * | 1/1998 | Morse | 473/422 |
| 5,718,640 | A | * | 2/1998 | Noblin | 473/212 |
| 6,012,993 | A | * | 1/2000 | Guerriero | 473/424 |
| 6,375,581 | B1 | * | 4/2002 | Urban et al. | 473/215 |
| 6,612,845 | B1 | * | 9/2003 | Macri et al. | 434/247 |

* cited by examiner

*Primary Examiner*—Mitra Aryanpour
(74) *Attorney, Agent, or Firm*—Armstrong, Kratz, Quintos, Hanson & Brooks, LLP

(57) ABSTRACT

A baseball training device for use in improving batting skills, particularly triggering skills while batting. The device comprises an elongated member of at least a length to extend about the torso of a wearer and form a loop, and a jacket conformable to the upper torso of a wearer and slidably secured to the elongated member, the jacket and the elongated member each including indicia to indicate a triggering movement by the wearer.

3 Claims, 2 Drawing Sheets

TRIGGERING DEVICE FOR BATTERS

This application claims benefit of 60/406,983 filed Aug. 30, 2002.

The present invention relates generally to devices for assisting persons to learn sports skills and, more particularly, to devices for assisting persons to learn or improve batting skills for playing the game of baseball.

In hitting a baseball, a batter should always move slightly back with his arms and front knee while he also takes his initial stride to the ball. The batter does this in order to either maintain or ascertain that his weight is back or still evenly distributed before he swings and to gain momentum into the swing. This is the triggering aspect of hitting. The triggering mechanism brings the bat to the preparatory to hit or launch position just prior to the swing.

SUMMARY OF THE INVENTION

It therefore is a feature of the subject invention to provide a device for assisting persons to learn and/or improve batting skills for playing the game of baseball.

It also is a feature of the subject invention to provide a device for assisting persons to learn and/or improve "triggering" skills when batting in the game of baseball.

Briefly, the present invention comprehends in its broader aspects a baseball training device for use in improving batting skills, particularly triggering skills while batting, the device comprising an elongated member of at least a length to extend about the upper torso of a wearer and form a loop, and a jacket conformable to the upper torso of a wearer and slidably secured to the elongated member, the jacket and the elongated member each including indicia to indicate a triggering movement by the wearer.

The present invention further comprehends a baseball training device for use in improving batting skills, particularly triggering skills while batting, the device comprising an elongated member of at least a length to extend about the upper torso of a wearer and having two distil ends, a fastener for engaging the two distal ends of the elongated member so as to form a loop, and a trigger member slidably secured to the elongated member, the device further including an arm member adapted to be secured about an upper arm of a wearer and having a projecting member adapted to engage the triggering member on movement of the arm of the wearer.

Further, the present invention comprehends in its broader aspects a baseball training device for use in improving batting skills, particularly triggering skills while batting, the device comprising an elongated member of at least a length to extend about the knee of a wearer and forming a loop, and a signaling device secured to the elongated member, the signaling device adapted to generate a signal when the knee of the wearer with the training device bends that knee toward the other knee of the wearer.

DETAILED DESCRIPTION OF THE PREFERRED EMBODIMENTS

Figure 2:
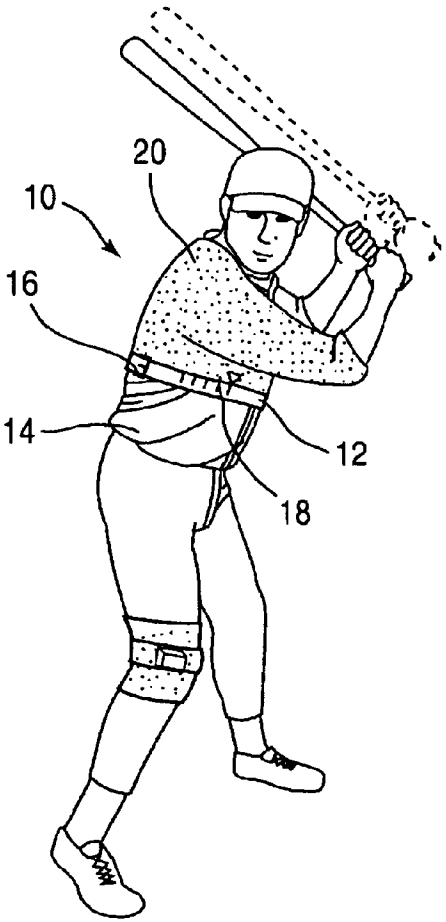
FIG. 2 illustrates in another perspective view of a baseball player wearing the embodiment of the training device of the invention and as shown in FIG. 1.
Figure 1:
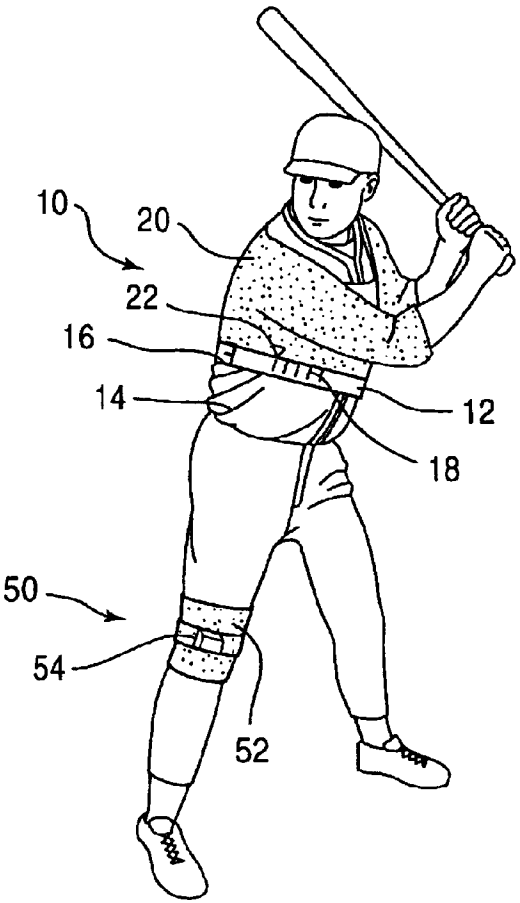
FIG. 1 is a perspective view of a baseball player wearing an embodiment of the training device in accordance with the present invention.

As shown in FIGS. 1 and 2 of the drawings, the training device 10 in accordance with the present invention comprises an elongated member 12 of at least a length to extend about torso of a wearer 14 just above the waist. Elongated member 10 has two distil ends, a fastener 16 for engaging the two distal ends of the elongated member so as to form a loop. Fastener 16 may be buckle, clasp, snap, hook-and-loop or other type of conventional fastener. In use, elongated member 12 is snugly cinched about the wearer such that member is not free to move relative to the wearer. Elongated member 12 further includes a series of marks 18 on the exterior thereof. For example, the elongated member may have five notches each spaced one-inch apart as marks 18.

Device 10 of this embodiment further includes a short jacket 20 of a length to extend downwardly such that the lower hem of jacket 20 reaches the upper part of elongated member 12. The hem of jacket 20 includes indicator 22 just above one of the series of marks 18 on elongated member 12. In the embodiment shown, the jacket is in the form of a continuous plastic harness that goes around the upper chest of the wearer and extends down below both arms just below the elbows.

The use of device 10 is illustrated in FIGS. 1 and 2. At the initial position of the swing as shown in FIG. 1, indicator 22 on jacket 20 is above the left hand mark 18 on elongated member 12. If marks 18 are at one inch intervals, when the batter moves his arms back one to five inches in the triggering motion as illustrated in FIG. 2, indicator 22 moves to show the amount of triggering motion. Thus, the batter can ascertain that he indeed moved his arms backward or triggered correctly.

Figure 3:
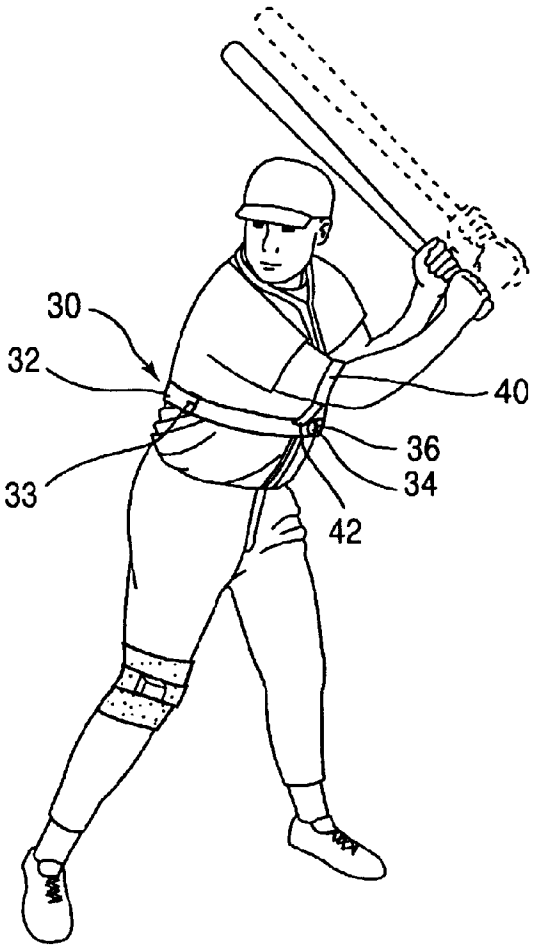
FIG. 3 is a perspective view of a baseball player wearing another embodiment of the training device in accordance with the present invention.
Figure 4:
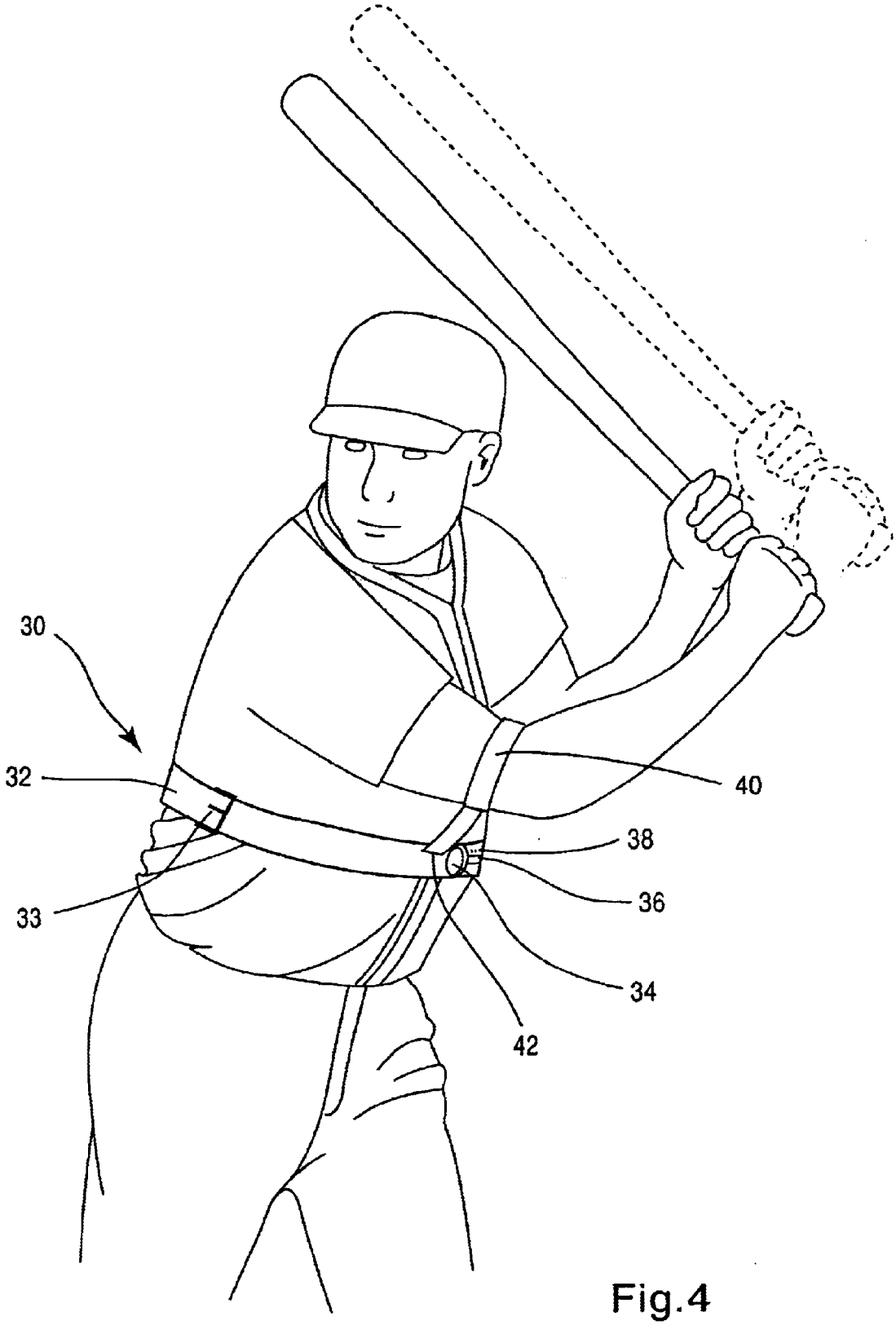
FIG. 4 is enlarged view of a portion of the view of FIG. 3.

Another embodiment of the training device in accordance with the present invention is shown in FIGS. 3 and 4. Baseball training device 30, like that of the first embodiment, comprises an elongated member 32 of at least a length to extend about the upper torso of a wearer just above the waist and having two distil ends, a fastener 33 for engaging the two distal ends of the elongated member so as to form a loop. As in the above embodiment, elongated member 32 of device 30 is able to be snugly cinched about the wearer such that member is not free to move relative to the wearer.

Secured to elongated member 32 is trigger member 34 projecting a short distance away from the torso of the wearer. Preferably, trigger member 34 is able to slide in a track 36 formed in elongated member, the track length having a series of marks 38 adjacent thereto.

Device 30 of this embodiment further includes arm member 40 in the form of a loop which is adapted to be secured about the upper arm of the wearer. Arm member 40 may have two distil ends and a fastener for engaging the two distal ends of the member so as to form a loop. The fastener may be of the type described above.

Secured to arm member 40 is projecting member 42 adapted to engage trigger member carried by elongated member 32. The length of projecting member 42 may vary considerably depending on the position of the elongated member 32 on the wearer, but preferably should be as short as possible so as to not interfere with the baseball swing.

Although arm member 40 is shown in the drawings as being secured to the arm of the batter which is closer to the pitcher of a ball to be hit, it is also within the scope of the present invention that the arm member could be secured to the other arm, that is, the arm which is further from the pitcher.

Preferably, but not necessarily, device 30 includes one or more shoulder straps (not shown) which extend from the elongated member 32 at the front of the wearer, over the shoulder of the wearer, and to the elongated member at the back of the wearer. One shoulder strap may be sufficient, but two straps may be preferable.

In use of the device 30, the wearer, upon initiation of the triggering motion, causes projecting member 42 to engage trigger member 34. This motion then causes trigger member 42 to slide in track 36 of elongated member 32 thereby giving a positive indication as to the triggering motion as well as an indication of the magnitude of the motion.

It is contemplated that the training devices in accordance with the present invention further may include a signal device (not shown) in connection with the elongated member to provide a positive indication in the form of a signal that the triggering has occurred. The signal device may generate an audible sound and/or a visual indication. The signal can be generated by mechanical and/or electrical devices such clickers, buzzers, lights and the like. Multiple signals can be produced so as to give an quantitative indication of the magnitude of the triggering motion. It is further contemplated that triggering motion could be sensed electronically rather than in the manners shown in the subject embodiments.

Training devices in accordance with the invention may be made of any suitable material such as cloth, rubber or polymeric materials.

The above described training devices may be used in conjunction with a knee device that provides an indication that the front knee is turned inward at the start of the triggering motion. As shown in FIG. 1, knee device 50 comprises an knee member 52 of at least a length to extend about the knee of a wearer and forming a loop, and a signaling device 54 secured to the elongated member. Signaling device 54 is adapted to generate a signal when the knee of the wearer with the training device bends that knee toward the other knee of the wearer. Signaling device 54 may generate an audible sound and/or a visual indication and the signal can be generated by mechanical and/or electrical devices such clickers, buzzers, lights and the like.

While there has been shown and described what are considered to be preferred embodiments of the present invention, it will be apparent to those skilled in the art to which the invention pertains that various changes and modifications may be made therein without departing from the subject invention.

It is claimed:

1. A baseball training device for use in improving batting skills, the device comprising a first elongated member of at least a length to extend about the upper torso of a wearer and having two distal ends, a fastener for engaging the two distal ends of the first elongated member so as to form a loop, and a trigger member slidably secured to the first elongated member, the device further including an arm member adapted to be secured about an upper arm of a wearer and having a projecting member adapted to engage the trigger member on movement of the arm of the wearer, the device further comprising a second elongated member of at least a length to extend about the knee of the wearer and forming a loop, and a signaling device secured to the second elongated member, the signaling device adapted to generate a signal when the knee of the wearer with the training device bends that knee toward the other knee of the wearer.

2. A baseball training device according to claim 1, wherein the trigger member is slidable in a track formed in the first elongated member, the track having a series of marks adjacent thereto.

3. A baseball training device according to claim 1, wherein the arm member has two distal ends and a fastener for engaging the two distal ends of the arm member so as to form a loop.

* * * * *